US006173726B1

(12) United States Patent
Talmadge

(10) Patent No.: US 6,173,726 B1
(45) Date of Patent: Jan. 16, 2001

(54) ERECTABLE SHELTER INCLUDING A COLLAPSIBLE TRUSS

(75) Inventor: Paul W. Talmadge, Apopka, FL (US)

(73) Assignee: Fiskars Inc., Madison, WI (US)

( * ) Notice: Under 35 U.S.C. 154(b), the term of this patent shall be extended for 0 days.

(21) Appl. No.: 09/207,613

(22) Filed: Dec. 9, 1998

(51) Int. Cl.[7] ..... E04H 15/46; E04H 15/52

(52) U.S. Cl. ..... 135/144; 135/143; 135/146; 135/122; 135/128; 135/139; 135/147; 135/158; 135/160; 52/641; 52/646

(58) Field of Search ..... 52/641, 643, 645, 52/646; 135/122, 128, 130, 131, 139–146, 157–160, 147

(56) References Cited

U.S. PATENT DOCUMENTS

| | | | |
|---|---|---|---|
| 684,130 | | 10/1901 | Taubert . |
| 1,326,006 | | 12/1919 | Sterhardt . |
| 1,493,915 | | 5/1924 | Baker . |
| 1,712,836 | | 5/1929 | Mills . |
| 1,728,356 | | 9/1929 | Morgan . |
| 1,853,367 | | 4/1932 | Mace . |
| 2,130,919 | * | 9/1938 | Erickson et al. . |
| 3,174,397 | | 3/1965 | Sanborn . |
| 3,199,518 | | 8/1965 | Glidewell . |
| 3,335,815 | | 8/1967 | Oakes . |
| 3,375,624 | | 4/1968 | Mikulin et al. . |
| 3,496,687 | | 2/1970 | Greenberg et al. . |
| 3,526,066 | | 9/1970 | Hagar et al. . |
| 4,156,433 | | 5/1979 | Beaulieu . |
| 4,607,656 | | 8/1986 | Carter . |
| 4,640,062 | * | 2/1987 | Rubik . |
| 4,641,676 | * | 2/1987 | Lynch . |
| 5,203,126 | * | 4/1993 | Sorenson et al. . |
| 5,228,258 | * | 7/1993 | Onoda et al. . |
| 5,490,533 | | 2/1996 | Carter . |
| 5,511,572 | | 4/1996 | Carter . |
| 5,632,292 | | 5/1997 | Carter . |
| 5,632,293 | | 5/1997 | Carter . |

FOREIGN PATENT DOCUMENTS

| | | |
|---|---|---|
| 1 434 526 | 12/1968 | (DE) . |
| 823693 | 1/1938 | (FR) . |
| 198803 | 6/1923 | (GB) . |
| 672815 | 5/1952 | (GB) . |
| 692885 | 8/1965 | (IT) . |

* cited by examiner

*Primary Examiner*—Robert Canfield
(74) *Attorney, Agent, or Firm*—Foley & Lardner

(57) ABSTRACT

The present invention is directed to a multi-side shelter that may assume a collapsed configuration or an erected configuration. In particular, the present invention is directed to a truss that may assume a collapsed configuration or an erected configuration, and that may be used in the shelter.

37 Claims, 8 Drawing Sheets

ERECTABLE SHELTER INCLUDING A COLLAPSIBLE TRUSS

BACKGROUND OF THE INVENTION

1. Field of the Invention

The present invention is directed to a multi-side shelter that may assume a collapsed configuration or an erected configuration. In particular, the present invention is directed to a truss that may assume a collapsed configuration or an erected configuration, and that may be used in a shelter.

Providing a shelter for protection from an ambient environment is generally considered a basic necessity. Traditionally, a shelter requires a substantial amount of time to construct, and is not easily moved from its construction site. However, there has arisen the need in special circumstances to provide a shelter that is readily transportable to a site, and that can be quickly set-up. Often, these shelters are intended to satisfy a temporary need, therefore these shelters must also be able to be quickly taken-down. Thus, it is also desirable for these shelters to be light enough to be easily moved, and durable enough to be reused many times.

2. Description of Related Art

Shelters for these special circumstances are typically constructed from a plurality of bars pivotally connected to one another so as to form a number of cooperative linkages that may assume a collapsed configuration and an erected configuration. In the erected configuration, a flexible sheet material is placed over the linkages so as to form a barrier between the ambient environment and the interior volume to be protected by the shelter.

A number of the convention shelters use linkages that are commonly known as lazy-tong type linkages. Alternatively, these linkages are also referred to as scissors or X-shaped linkages. A lazy-tong linkage includes at least one pair of bars that are pivotally connected at a common point along the length of each bar. In operation, first ends and second ends of each bar are respectively located relatively proximate to one another in a first configuration. In a second configuration, the bars are pivoted relative to one another about the common point such that the first end of each bar becomes relatively proximate to the respective second end of the other bar. Thus, reconfiguring a lazy-tong linkage reorients the greatest dimension of the pair of bars by 90°. For example, if the bars of a lazy-tong linkage were initially oriented in a generally vertical configuration, operating the linkage would reorient the bars in a generally horizontal configuration.

In many conventional shelters, several lazy-tong linkages are successively joined by pivotally connecting two of the ends of one pair of bars to two of the ends of another pair of bars. The number of successively connected lazy-tong linkages generally corresponds to the ratio of the greatest dimension of the linkages in the erected configuration with respect to the greatest dimension of the linkages in the collapsed configuration. For example, a truss including three successively connected lazy-tong linkages would be able to assume a horizontal length in the erected configuration that is approximately three times its vertical length in the collapsed configuration.

Examples of conventional shelters using lazy-tong linkages to assume collapsed and erected configurations include the following U.S. Patents: U.S. Pat. No. 5,632,293 to Carter; U.S. Pat. No. 5,632,292 to Carter; U.S. Pat. No. 5,511,572 to Carter; U.S. Pat. No. 5,490,533 to Carter; U.S. Pat. No. 4,607,656 to Carter; U.S. Pat. No. 4,156,433 to Beaulieu; U.S. Pat. No. 3,526,066 to Hagar et al.; U.S. Pat. No. 3,496,687 to Greenberg et al.; U.S. Pat. No. 3,375,624 to Mikulin; U.S. Pat. No. 3,335,815 to Oakes; U.S. Pat. No. 3,199,518 to Glidewell; U.S. Pat. No. 3,174,397 to Sanborn; U.S. Pat. No. 1,853,367 to Mace; U.S. Pat. No. 1,728,356 to Morgan; and U.S. Pat. No. 1,712,836 to Mills.

Additional examples of conventional shelters using lazy-tong linkages to assume collapsed and erected configurations include German Patent 1 434 526; Italian Patent 692885; Great Britain Patent 672,815; French Patent 823.693; and Great Britain Patent 198,803.

U.S. Pat. No. 684,130 to Taubert discloses a screen having upper and lower trusses that each include a plurality of lazy-tong linkages.

Such conventional trusses and shelters constructed using lazy-tong type linkages suffer from a number of disadvantages including concentrating stress forces at its weakest points. All bending, torsion and shear forces that are applied to a truss constructed of one or more lazy-tong linkages are concentrated at the common pivot point for the bars. Moreover, this common pivot point is often the weakest portion of each bar due to the holes or other connecting structures necessary to form the pivot mechanism per se.

Another disadvantage of such conventional trusses and shelters constructed using lazy-tong type linkages is the lack of an inherently balanced position. Specifically, there is no tendency for a lazy-tong linkage to assume a balanced configuration since the lazy-tong linkage is never fully extended. That is to say, the bars of the lazy-tong linkage may not assume a parallel relationship for various practical and theoretical reasons. From a practical standpoint, the pivotal connections at the ends of conventional lazy-tong linkages would obstruct one another unless the ends were modified to form a lap joint. However, a lazy-tong linkage using lap joints cannot be fully collapsed because of bodies of the bars would obstruct one another. From a theoretical standpoint, allowing the bars of a lazy-tong linkage to assume a parallel relationship prevents the linkage from carrying any loads acting transversely to the plane of the parallel bars. That is to say, parallel bars primarily carry only tensile or compressive loads acting along the axes of the bars.

Examples of other known shelters that do not use lazy-tong linkages to assume collapsed and erected configurations include U.S. Pat. No. 1,493,915 to Baker and U.S. Pat. No. 1,326,006 to Sterhardt. Both of these patents disclose connecting trusses having a singular element that spans between legs of the shelters. These known shelters suffer at least one of the same disadvantages as those of the conventional trusses in that the stress forces are concentrated at the connection points for the spanning element. Further, these known shelters require complicated locking arrangements to maintain the collapsed and/or erected configurations. Additionally, because only one element is used, the size, weight and/or cost of manufacturing the spanning element must necessarily be increased to carry the loads imposed thereon.

BRIEF SUMMARY OF THE INVENTION

The present invention comprises a combination of bars and brackets pivotally connected in a geometrical arrangement that overcomes the disadvantages of the prior art. In particular, the present invention comprises a pair of parallelogram linkages sharing a common center bracket that forms one link of each of the parallelogram linkages. In an erected configuration, the bars of each parallelogram are generally collinear with respect to the corresponding bars of the other parallelogram, thus providing the maximum possible extension of the truss. Moreover, a simple lock providing only a minimal balancing force is required to maintain the truss in the erected configuration.

Unlike the prior art that uses lazy-tong linkages, the present invention provides the maximum possible extension at a readily balanced position of the linkage. Moreover, the linkage according to the present invention includes plural spanning elements that provide strength and durability in the erected configuration, as well as a compact and lightweight collapsed configuration.

The geometry of the center bracket according to the present invention provides numerous advantages including maintaining the bars in a spaced parallel relationship at all positions between the collapsed and erected configurations, and automatically adjusting spacing between the parallel bars to maximize strength in the erected configuration and to minimize the space occupied in the collapsed configuration.

A truss, a shelter frame, or a shelter according to the present invention also provides unexpected strength as compared to that of conventional arrangements having substantially the same weight, providing substantially the same erected length, and/or protecting substantially the same interior volume.

An object of the present invention is to provide a truss, or a shelter having the truss, that may readily assume a sturdy, erected configuration and a compact, collapsed configuration.

Another object of the present invention is to provide a truss, or a shelter having the truss, that is constructed of lightweight, readily available materials that produce a sturdy, reusable shelter that may be easily transported.

A further object of the present invention is to provide a shelter that is inherently balanced when assuming and/or maintaining at least one of the erected and collapsed configurations.

These and other objects and advantages of the present invention are achieved by a truss adapted for assuming a collapsed configuration and an erected configuration. The truss comprises a pair of first eave bars extending from a center bracket to a first end bracket, each bar of the pair of first bars is pivotally connected to the center bracket and to the first end bracket, the pair of first eave bars pivot with respect to the first and center brackets and are parallel to one another between the collapsed configuration and the erected configuration; and a pair of second eave bars extending from the center bracket to a second end bracket, each bar of the pair of second bars is pivotally connected to the center bracket and to the second end bracket, the pair of second eave bars pivot with respect to the second and center brackets and are parallel to one another between the collapsed configuration and the erected configuration.

The aforementioned and other objects and advantages of the present invention are also achieved by a shelter frame adapted for assuming a collapsed configuration and an erect configuration. The shelter frame comprises at least three legs, each of the legs having an upper portion and a lower portion, with at least two truss members is connected to each of the legs. Each of the truss members includes a first end bracket supported on a first one of the legs and a second end bracket supported on a second one of the legs; a pair of first eave bars extend from a center bracket to the first end bracket, each bar of the pair of first bars is pivotally connected to the center bracket and to the first end bracket, the pair of first eave bars pivot with respect to the first and center brackets and are parallel to one another between the collapsed configuration and the erected configuration; and a pair of second eave bars extending from the center bracket to the second end bracket, each bar of the pair of second bars is pivotally connected to the center bracket and to the second end bracket, the pair of second eave bars pivot with respect to the second and center brackets and are parallel to one another between the collapsed configuration and the erected configuration.

The aforementioned and other objects and advantages of the present invention are further achieved by a square shelter adapted for assuming a collapsed configuration and an erect configuration. The shelter comprises four legs, each of the legs defining a vertex of the square; and four truss members defining a perimeter of the square. Each of the truss members connects two of the legs. The truss members includes a first truss member having a first end bracket supported on a first one of the legs and a second end bracket supported on a second one of the legs; a first pair of first eave bars extending from a first center bracket to the first end bracket, each bar of the first pair of first bars is pivotally connected to the first center bracket and to the first end bracket, the first pair of first eave bars pivot with respect to the first end and first center brackets and are parallel to one another between the collapsed configuration and the erected configuration; and a first pair of second eave bars extending from the first center bracket to the second end bracket, each bar of the first pair of second bars is pivotally connected to the first center bracket and to the second end bracket, the first pair of second eave bars pivot with respect to the second end and first center brackets and are parallel to one another between the collapsed configuration and the erected configuration; a second truss member having a third end bracket supported on a third one of the legs; a second pair of first eave bars extending from a second center bracket to the second end bracket, each bar of the second pair of first bars is pivotally connected to the second center bracket and to the second end bracket, the second pair of first eave bars pivot with respect to the second end and second center brackets and are parallel to one another between the collapsed configuration and the erected configuration; and a second pair of second eave bars extending from the second center bracket to the third end bracket, each bar of the second pair of second bars is pivotally connected to the second center bracket and to the third end bracket, the second pair of second eave bars pivot with respect to the third end and second center brackets and are parallel to one another between the collapsed configuration and the erected configuration; a third truss member having a fourth end bracket supported on a fourth one of the legs; a third pair of first eave bars extending from a third center bracket to the third end bracket, each bar of the third pair of first bars is pivotally connected to the third center bracket and to the third end bracket, the third pair of first eave bars pivot with respect to the third end and third center brackets and are parallel to one another between the collapsed configuration and the erected configuration; and a third pair of second eave bars extending from the third center bracket to the fourth end bracket, each bar of the third pair of second bars is pivotally connected to the third center bracket and to the fourth end bracket, the third pair of second eave bars pivot with respect to the fourth end and third center brackets and are parallel to one another between the collapsed configuration and the erected configuration; and a fourth truss member extending between the fourth and first end brackets; a fourth pair of first eave bars extending from a fourth center bracket to the fourth end bracket, each bar of the fourth pair of first bars is pivotally connected to the fourth center bracket and to the fourth end bracket, the fourth pair of first eave bars pivot with respect to the fourth end and fourth center brackets and are parallel to one another between the collapsed configuration and the erected configuration; and a fourth pair of second eave bars extending from the fourth center bracket to the first end bracket, each bar of the fourth pair of second bars is pivotally connected to the fourth center bracket and to the first end bracket, the fourth pair of second eave bars pivot with respect to the first end and fourth center brackets and are parallel to one another between the collapsed configuration and the erected configuration. A covering is supported on the legs and the truss members, the covering is adapted for extending between the truss members in the erected configuration.

Additional objects and advantages of the invention will be set forth in the description that follows, and in part will be readily apparent to those skilled in the art from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiments of the invention, and, together with the general description given above and the detailed description of the preferred embodiments given below, serve to explain the principles of the invention.

FIG. 8A is a top plan view, FIG. 8B is a front perspective view, and FIG. 8C is a rear perspective view.

DETAILED DESCRIPTION OF THE INVENTION

Figure 1:
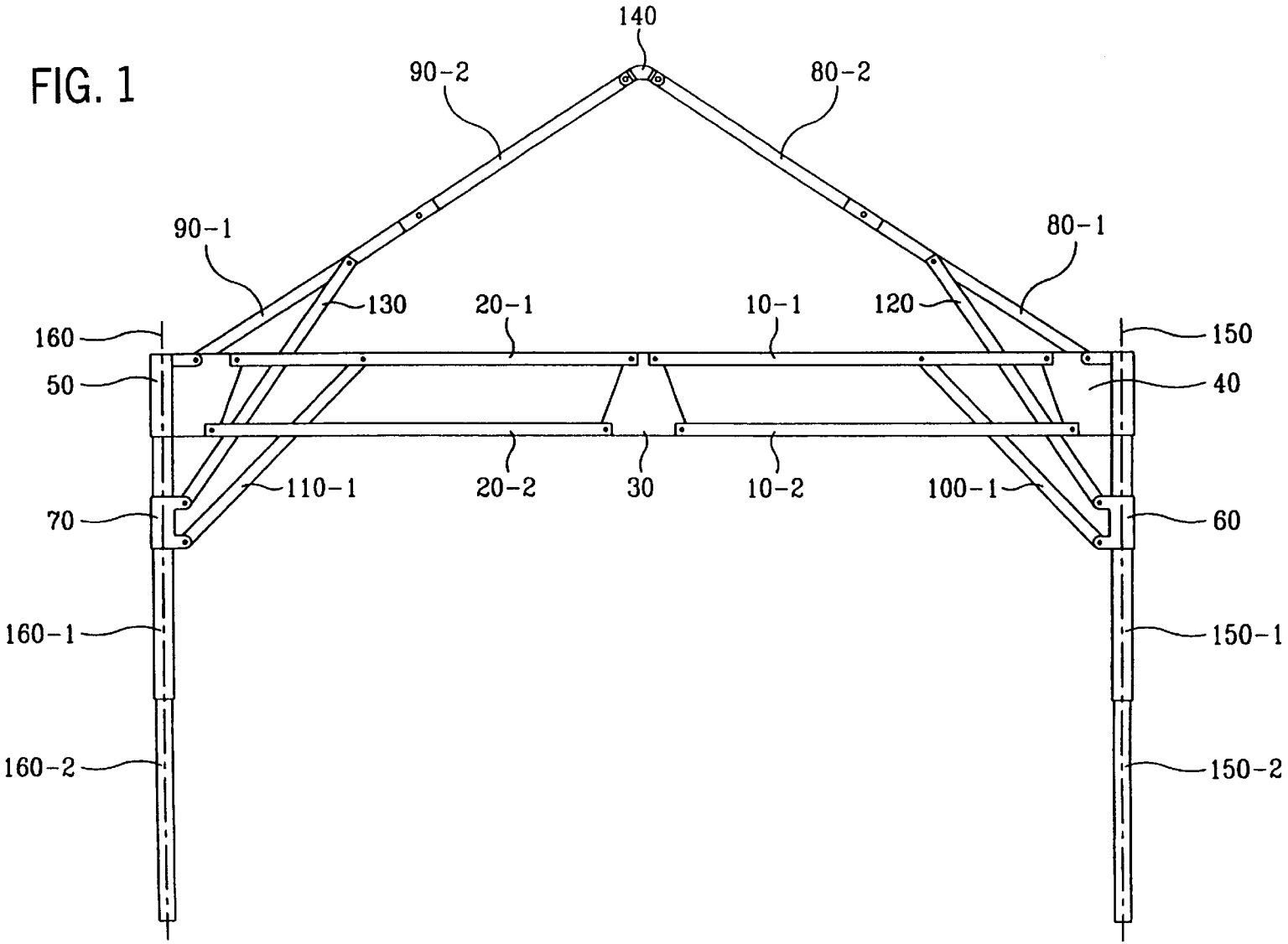
FIG. 1 shows a first exemplary embodiment of a truss according to the present invention in an erected configuration.
Figure 3:
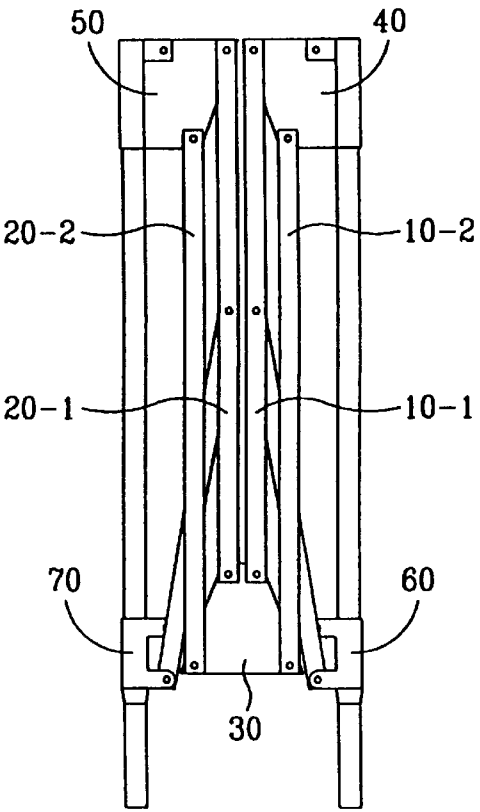
FIG. 3 shows the first exemplary embodiment of the truss according to FIG. 1 in a collapsed configuration.
Figure 2:
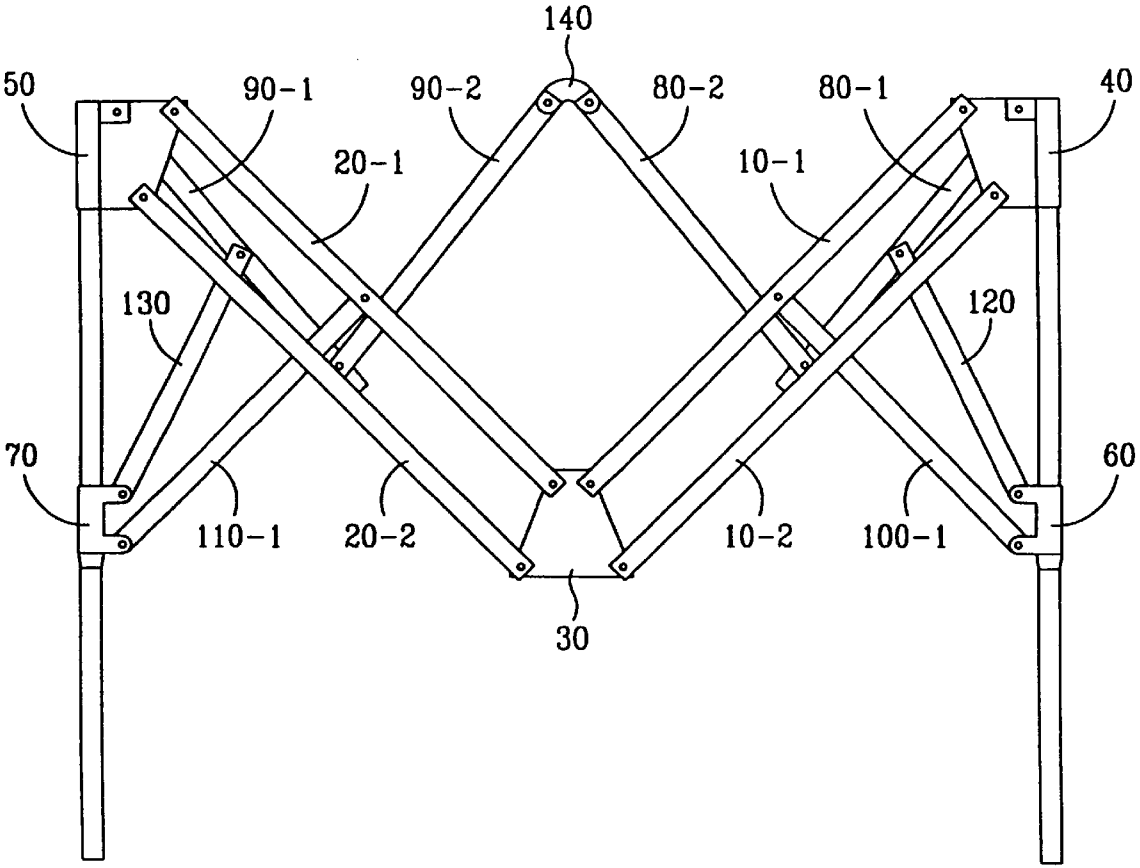
FIG. 2 shows the first exemplary embodiment of the truss according to FIG. 1 in an intermediate position between the erected and collapsed configurations.

Referring to FIGS. 1–3, a pair of first eave bars 10-1,10-2 extend from a center bracket 30 to a first end bracket 40. The first eave bars 10-1,10-2 are equal length and each of the first eave bars 10-1,10-2 is pivotally connected at its ends to the center bracket 30 and to the first end bracket 40.

The pair of first eave bars 10-1,10-2, the center bracket 30 and the first end bracket 40 define a first parallelogram linkage. Regardless of the relative position of the center bracket 30 with respect to the first end bracket 40, the pair of first eave bars 10-1,10-2 remain parallel to one another.

A pair of second eave bars 20-1,20-2 extend from the center bracket 30 to a second end bracket 50. The second eave bars 20-1,20-2 are equal length and each of the second eave bars 20-1,20-2 is pivotally connected at its ends to the center bracket 30 and to the second end bracket 50.

The pair of second eave bars 20-1,20-2, the center bracket 30 and the second end bracket 50 define a second parallelogram linkage. Regardless of the relative position of the center bracket 30 with respect to the second end bracket 50, the pair of second eave bars 20-1,20-2 remain parallel to one another.

The four pivotal connections of the center bracket 30 with respect to the four eave bars 10-1,10-2,20-1,20-2 define a quadrilateral. The quadrilateral has four sides by definition. According to the present invention, first and second opposite sides of the quadrilateral are parallel and spaced apart from one another, and third and fourth sides of the quadrilateral extend obliquely between the parallel sides. Each of the obliquely extending sides forms a common acute angle with respect to first ones of the pairs of eave bars 10-1,20-1, and each of the obliquely extending sides forms a common obtuse angle with respect to second ones of the pairs of eave bars 10-2,20-2. The acute and obtuse angles are supplementary. Consequently, the first side is relatively shorter than the second side.

A first support bar 100-1 extends from the eave bar 10-1 to a third end bracket 60. The ends of the first support bar 100-1 are pivotally connected to an intermediate point along the eave bar 10-1 and to the third end bracket 60. A second support bar 110-1 extends from the eave bar 20-1 to a fourth end bracket 70. Ends of the second support bar 110-1 are pivotally connected to an intermediate point along the eave bar 20-1 and to the fourth end bracket 70.

The first and third end brackets 40,60 may be displaced with respect to one another along a first axis 150, and the second and fourth brackets 50,70 may be displaced with respect to one another along a second axis 160. The first and third end brackets 40,60 are relatively proximal in the erected configuration of the truss, and are relatively distal in the collapsed configuration of the truss. Similarly, the second and fourth end brackets 50,70 are relatively proximal in the erected configuration of the truss, and are relatively distal in the collapsed configuration of the truss. The first and second axes 150,160 are parallel with respect to one another, and the spacing between the first and second axes 150,160 varies between a minimum in the collapsed configuration of the truss and a maximum in the erected configuration of the truss.

A ridge structure for the truss includes a pair of first ridge bars 80-1,80-2 and a pair of second ridge bars 90-1,90-2. Ends of the ridge bars 80-1,90-1 are pivotally connected to the first and second end brackets 40,50, respectively, and pivotally connected to the corresponding ridge bars 80-2, 90-2, respectively. Ends of the ridge bars 80-2,90-2, in addition to being pivotally connected to the corresponding ridge bars 80-1,90-1, respectively, are also pivotally connected to one another at a ridge peak 140. The range of motion of the pairs of ridge bars 80-1,80-2 and 90-1,90-2 at their respective pivotal connections are constrained, such as by extensions of the ridge bars 80-1,90-1, to ensure a substantially collinear relationship in the erected configuration of the truss.

A third support bar 120 extends from the ridge bar 80-1 to the third end bracket 60. The ends of the third support bar 120 are pivotally connected to an intermediate point along the ridge bar 80-1 and to the third end bracket 60. A fourth support bar 130 extends from the ridge bar 90-1 to the fourth end bracket 70. Ends of the fourth support bar 130 are pivotally connected to an intermediate point along the ridge bar 90-1 and to the fourth end bracket 70.

In operation, the truss according to the first exemplary embodiment of the invention is maintained in an erected configuration by maintaining the third and fourth end brackets 60,70 in their proximal relationship with respect to the first and second end brackets 40,50, respectively. In the erected configuration, pairs of eave bars 10-1,20-1 and 10-2,20-2 are substantially collinear and all of the eave bars 10-1,10-2,20-1,20-2 are substantially parallel with respect to one another.

The proximal relationship of the corresponding pairs of end brackets 40,60 and 50,70 provide support bars 100-1, 110-1 with the minimal locking force necessary to balance only the load caused by the gravitational force acting on the parallelogram linkages. In the erected configuration, the locking force is also required to balance a very small load necessary to maintain the ridge beams 80,90 in their collinear relationship. However, the relatively more significant load caused by the gravitational force acting on the ridge beams 80,90 is transferred in a known manner to vertical loads acting along the axes 150,160 and a tensile load acting between the axes 150,160. The collinear and parallel relationship of the eave bars 10-1,10-2,20-1,20-2 carry the tensile and any compressive forces acting between the axes 150,160.

In a preferred embodiment of the present invention, a resiliently biased lock is used to secure the position of the third and fourth end brackets 60,70 with respect to the first and second end brackets 40,50, respectively. According to a most preferred embodiment of the present invention, the first end bracket 40 is secured to an upper portion of a first support leg comprising hollow telescopic sections 150-1 and 150-2. Similarly, the second end bracket 50 is secured at an upper portion of a second support leg comprising hollow telescopic sections 160-1 and 160-2. According to a most preferred embodiment, the relative positions of the third and fourth end brackets 60,70 with respect to the telescopic sections 150-1,160-1, respectively, and the relative positions of the telescopic sections 150-2,160-2 with respect to the telescopic sections 150-1,150-2, respectively, are maintained in the erected and/or collapsed configurations by resiliently biased lock pins engaging corresponding holes in each of the third and fourth end brackets 60,70 and the telescopic sections 150-1,150-2,160-1,160-2.

FIG. 2 shows an arbitrary intermediate position between the erected and collapsed configurations. Releasing the locking force allows the third and fourth end brackets 60,70 to be displaced along the corresponding axes 150,160 from their proximal relationship with respect to the first and second end brackets 40,50, respectively. This in turn allows the center bracket 30 to move downward, such as under the force of gravity, and the axes 150,160 to be drawn toward one another. Concurrently, the force maintaining the ridge beams 80,90 in their respective collinear relationships is released and the ridge peak, i.e., the pivotal connection between the ridge beams 80-2,90-2 at the ridge peak 140, also moves downward.

FIG. 3 shows the collapsed configuration wherein the third and fourth end brackets 60,70 have been displaced along the corresponding axes 150,160 to their distal relationship with respect to the first and second end brackets 40,50, respectively. In the collapsed configuration, the center bracket 30 and ridge peak have moved downward to their lowest position and the axes 150,160 have been drawn toward one another to a position of minimal spacing therebetween.

In the collapsed configuration, the eave bars 10-1,10-2, 20-1,20-2 and the axes 150,160 are substantially parallel to one another due to the arrangement and geometry of the center bracket 30, the first end bracket 40 and the second end bracket 50. This parallel relationship between the eave bars 10-1,10-2,20-1,20-2 and the axes 150,160 minimizes the size of the truss in the collapsed configuration.

Figure 4:
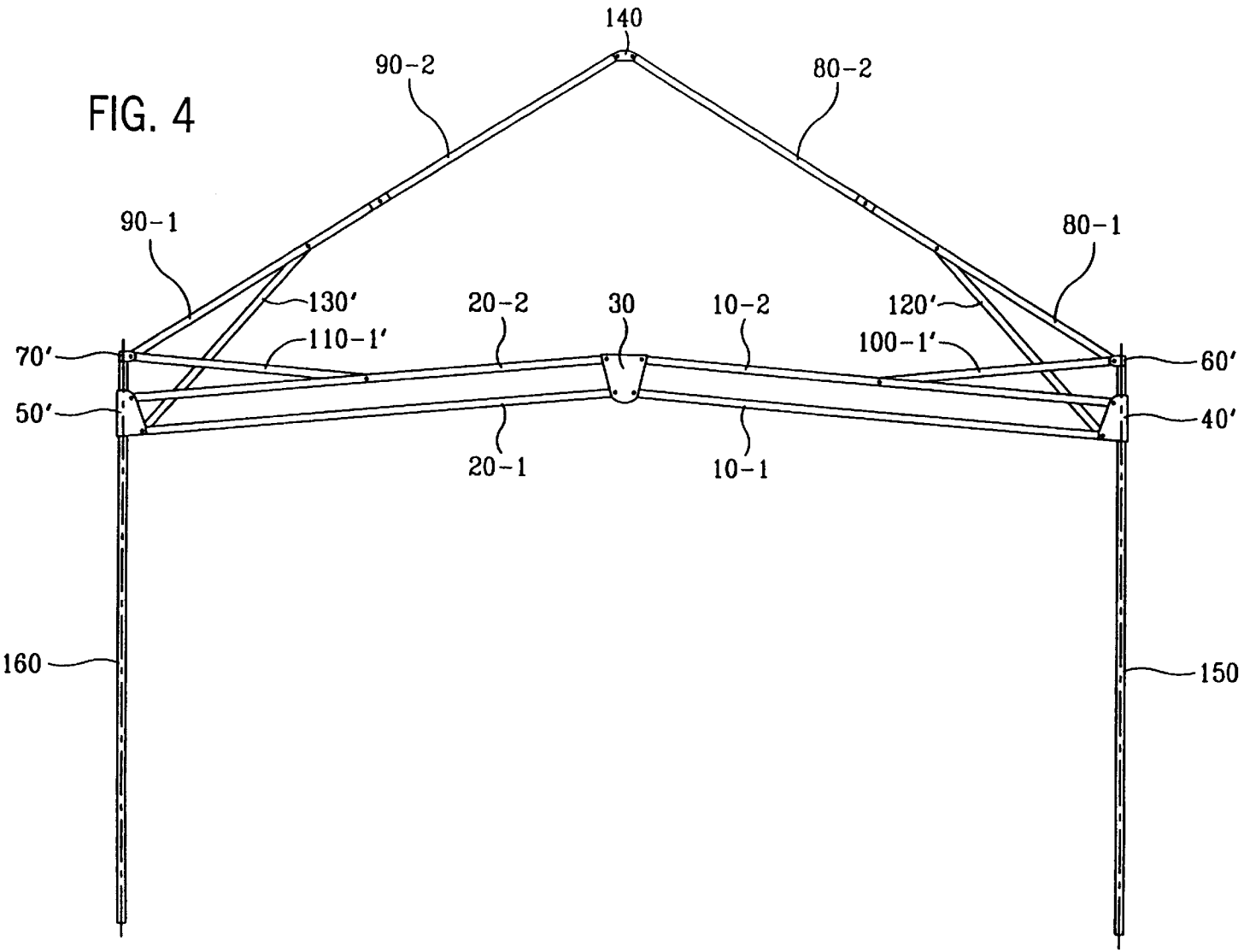
FIG. 4 shows a second exemplary embodiment of a truss according to the present invention in an erected configuration.
Figure 6:
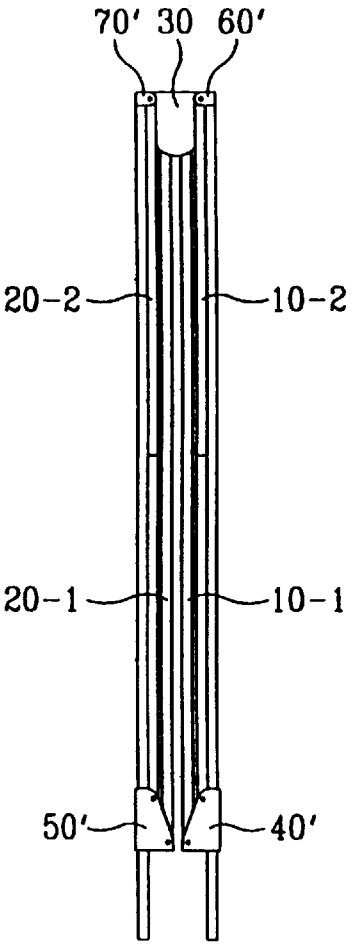
FIG. 6 shows the second exemplary embodiment of the truss according to FIG. 4 in a collapsed configuration.
Figure 5:
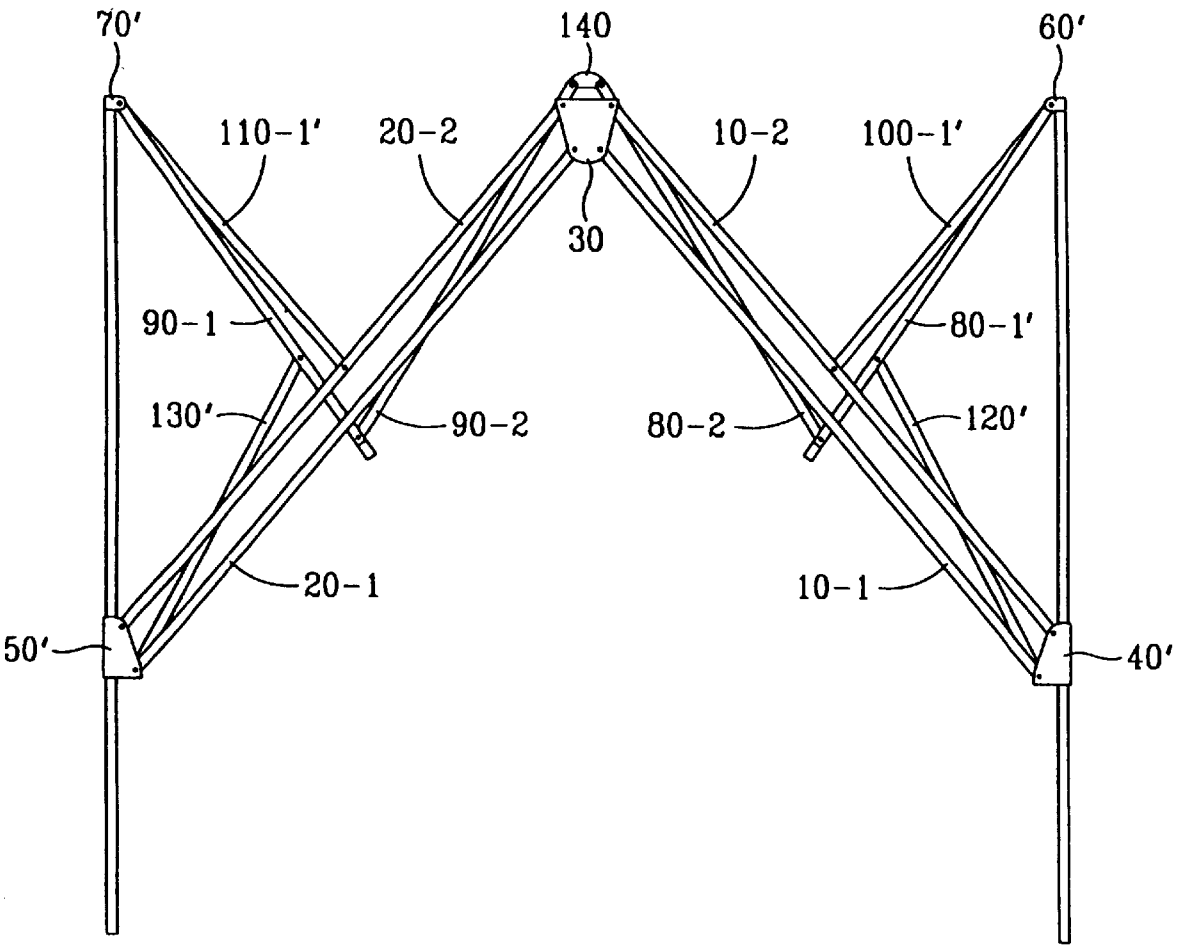
FIG. 5 shows the second exemplary embodiment of the truss according to FIG. 4 in an intermediate position between the erected and collapsed configurations.

A second exemplary embodiment of a truss according to the present invention is illustrated in FIGS. 4–6. Features that are similar to those of the first exemplary embodiment have been assigned the same reference numbers.

The second exemplary embodiment differs structurally from the first exemplary embodiment insofar as the first support bar 100-1' is pivotally connected to the eave bar 10-2 and to the third end bracket 60'; the second support bar 110-1' is pivotally connected to the eave bar 20-2 and to the fourth end bracket 70'; the third support bar 120' is pivotally connected to the ridge bar 80-1 and to the first end bracket 40'; the fourth support bar 130' is pivotally connected to the ridge bar 90-1 and to the second end bracket 50'; the ridge bar 80-1 is pivotally connected to the third end bracket 60'; and the ridge bar 90-1 is pivotally connected to the fourth end bracket 70'. Additionally, the first support bar 100-1' and the ridge bar 80-1 share a common pivot axis with respect to the third end bracket 60'; the second support bar 110-1' and the ridge beam 90-1 share a common pivot axis with respect to the fourth end bracket 70'; the third support bar 120' and the eave bar 10-1 share a common pivot axes with respect to the first end bracket 40'; and the fourth support bar 130' and the eave bar 20-1 share a common pivot axis with respect to the second end bracket 50'.

The second exemplary embodiment also differs from the first exemplary embodiment in both the erected configuration as well as the collapsed configuration. In the erected configuration, the eave bars 10-1,10-2,20-1,20-2 do not assume a collinear arrangement as in the first exemplary embodiment. However, the wide-angle inverted chevron configuration assumed by the eave bars 10-1,10-2,20-1,20-2 in the erected configuration requires only a small locking force for maintaining the first and second end brackets 40',50' in their relatively proximal relationship with respect to the third and fourth end brackets 60',70', respectively. In the collapsed configuration, the aforementioned common pivot axes enable the truss according to the second exemplary embodiment to assume a reduced transverse dimension as shown in FIG. 6. However, the length of the second exemplary embodiment in the collapsed configuration may be greater than that of the first exemplary embodiment.

FIG. 5 shows an arbitrary intermediate position between the erected and collapsed configurations wherein the ridge peak 140 has moved down substantially to the level of the center bracket 30. The center bracket 30 and ridge peak 140 remain at substantially the same level as the third and fourth end brackets 60',70' in the collapsed configuration.

For each embodiment of a truss according to the present invention, a number of variations are also envisioned. In particular, it is envisioned that one or more gas charged extendable struts 200 might be installed as the third support bar 120,120' and/or fourth support bar 130,130'. Such a substitution would aid in erecting the truss symmetrically. Additionally, it is envisioned that the ridge beams may have an alternative arrangement such as a multi-segment tubular element having an elastic tensile element, e.g., a so-called "bungee cord", extending through and retaining the segments in an assembled arrangement. Although the combination truss and ridge structure according to the present invention has been illustrated as lying substantially in a single plane, the ridge structure may extend in an obliquely oriented plane with respect to the plane of the parallelogram linkages.

Figure 7:
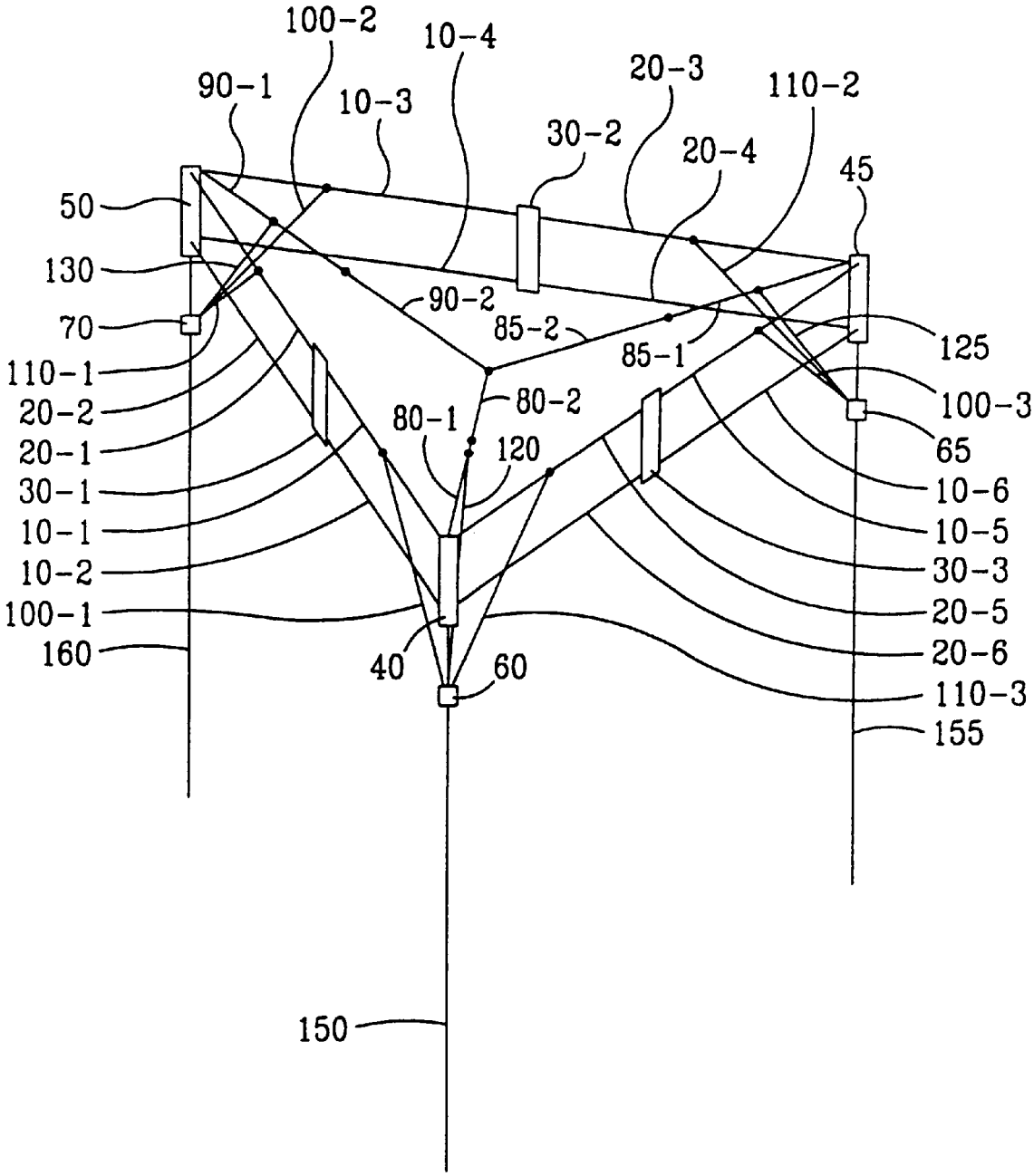
FIG. 7 is a perspective view of an exemplary shelter frame according to the present invention having three sides defined by trusses according to the first exemplary embodiment illustrated in FIGS. 1–3.

FIG. 7 shows an exemplary shelter frame according to the present invention having three legs 150,155,160 connected by trusses defining the perimeter of a three-sided shelter frame. It is envisioned that additional legs, sides and/or trusses may be combined so as to form any multi-sided polygon shaped shelter frame. The trusses shown in FIG. 7 are constructed according to the first exemplary embodiment described above. However, the trusses may alternatively be constructed according to the second exemplary embodiment described above, or any other arrangement within the scope of the appended claims.

A first pair of first eave bars 10-1,10-2 extend from a first center bracket 30-1 to a first end bracket 40. Each of the first eave bars 10-1,10-2 is pivotally connected at its ends to the first center bracket 30-1 and to the first end bracket 40.

A first pair of second eave bars 20-1,20-2 extend from the first center bracket 30-1 to a second end bracket 50. Each of the second eave bars 20-1,20-2 is pivotally connected at its ends to the first center bracket 30-1 and to the second end bracket 50.

A first support bar 100-1 extends from the eave bar 10-1 to a third end bracket 60. The ends of the first support bar 100-1 are pivotally connected to an intermediate point along the eave bar 10-1 and to the third end bracket 60. A second support bar 110-1 extends from the eave bar 20-1 to a fourth end bracket 70. Ends of the second support bar 110-1 are pivotally connected to an intermediate point along the eave bar 20-1 and to the fourth end bracket 70.

A second pair of first eave bars 10-3,10-4 extend from a second center bracket 30-2 to the second end bracket 50. Each of the first eave bars 10-3,10-4 is pivotally connected at its ends to the second center bracket 30-2 and to the second end bracket 50.

A second pair of second eave bars 20-3,20-4 extend from the second center bracket 30-2 to a fifth end bracket 45. Each of the second eave bars 20-3,20-4 is pivotally connected at its ends to the second center bracket 30-2 and the fifth end bracket 45.

A third support bar 100-2 extends from the eave bar 10-3 to the fourth end bracket 70. The ends of the third support bar 100-2 are pivotally connected to an intermediate point along the eave bar 10-3 and to the fourth end bracket 70. A fourth support bar 110-2 extends from the eave bar 20-3 to a sixth end bracket 65. Ends of the fourth support bar 110-2 are pivotally connected to an intermediate point along the eave bar 20-3 and to the sixth end bracket 65.

A third pair of first eave bars 10-5,10-6 extend from a third center bracket 30-3 to the fifth end bracket 45. Each of the first eave bars 10-5,10-6 is pivotally connected at its ends to the third center bracket 30-3 and to the fifth end bracket 45.

A third pair of second eave bars 20-5,20-6 extend from the third center bracket 30-3 to the first end bracket 40. Each of the second cave bars 20-5,20-6 is pivotally connected at its ends to the third center bracket 30-3 and the first end bracket 40.

A fifth support bar 100-3 extends from the eave bar 10-5 to the sixth end bracket 65. The ends of the fifth support bar 100-3 are pivotally connected to an intermediate point along the eave bar 10-5 and to the sixth end bracket 65. A sixth support bar 110-3 extends from the eave bar 20-5 to the third end bracket 60. Ends of the sixth support bar 110-3 are pivotally connected to an intermediate point along the eave bar 20-5 and to the third end bracket 60.

The first eave bars 10-1,10-2,10-3,10-4,10-5,10-6 and the second eave bars 20-1,20-2,20-3,20-4,20-5,20-6 are all equal length.

The first and third end brackets 40,60 may be displaced with respect to one another along the first leg 150, the second and fourth end brackets 50,70 may be displaced with respect to one another along the second leg 160, and the fifth and sixth end brackets 45,65 may be displaced with respect to one another along the third leg 155. In the erected configuration of the truss, the first and third end brackets 40,60 are relatively proximal, the second and fourth end brackets 50,70 are relatively proximal, and the fifth and sixth end brackets 45,65 are relatively proximal. In the collapsed configuration of the truss, the first and third end brackets 40,60 are relatively distal, the second and fourth end brackets 50,70 are relatively distal, and the fifth and sixth end brackets 45,65 are relatively distal.

A ridge structure for the truss includes a pair of first ridge bars 80-1,80-2, a pair of second ridge bars 90-1,90-2 and a pair of third ridge bars 85-1,85-2. Ends of the ridge bars 80-1,90-1,85-1 are pivotally connected to the first, second and fifth end brackets 40,50,45, respectively, and pivotally connected to the corresponding ridge bars 80-2,90-2,85-1, respectively. Ends of the ridge bars 80-2,90-2,85-2, in addition to being pivotally connected to the corresponding ridge bars 80-1,90-1,85-1, respectively, are also pivotally connected to one another at the ridge peak 140. The range of motion of the pairs of ridge bars 80-1,80-2, 90-1,90-2 and 85-1,85-2 at their respective pivotal connections are constrained, such as by extensions of the ridge bars 80-1, 90-1,85-1 to ensure a substantially collinear relationship in the erected configuration of the truss.

A seventh support bar 120 extends from the ridge bar 80-1 to the third end bracket 60. The ends of the seventh support bar 120 are pivotally connected to an intermediate point along the ridge bar 80-1 and to the third end bracket 60. An eighth support bar 130 extends from the ridge bar 90-1 to the fourth end bracket 70. Ends of the eighth support bar 130 are pivotally connected to an intermediate point along the ridge bar 90-1 and to the fourth end bracket 70. A ninth support bar 125 extends from the ridge bar 85-1 to the sixth end bracket 65. The ends of the ninth support bar 125 are pivotally connected to an intermediate point along the ridge bar 85-1 and to the sixth end bracket 65.

Figure 8B:
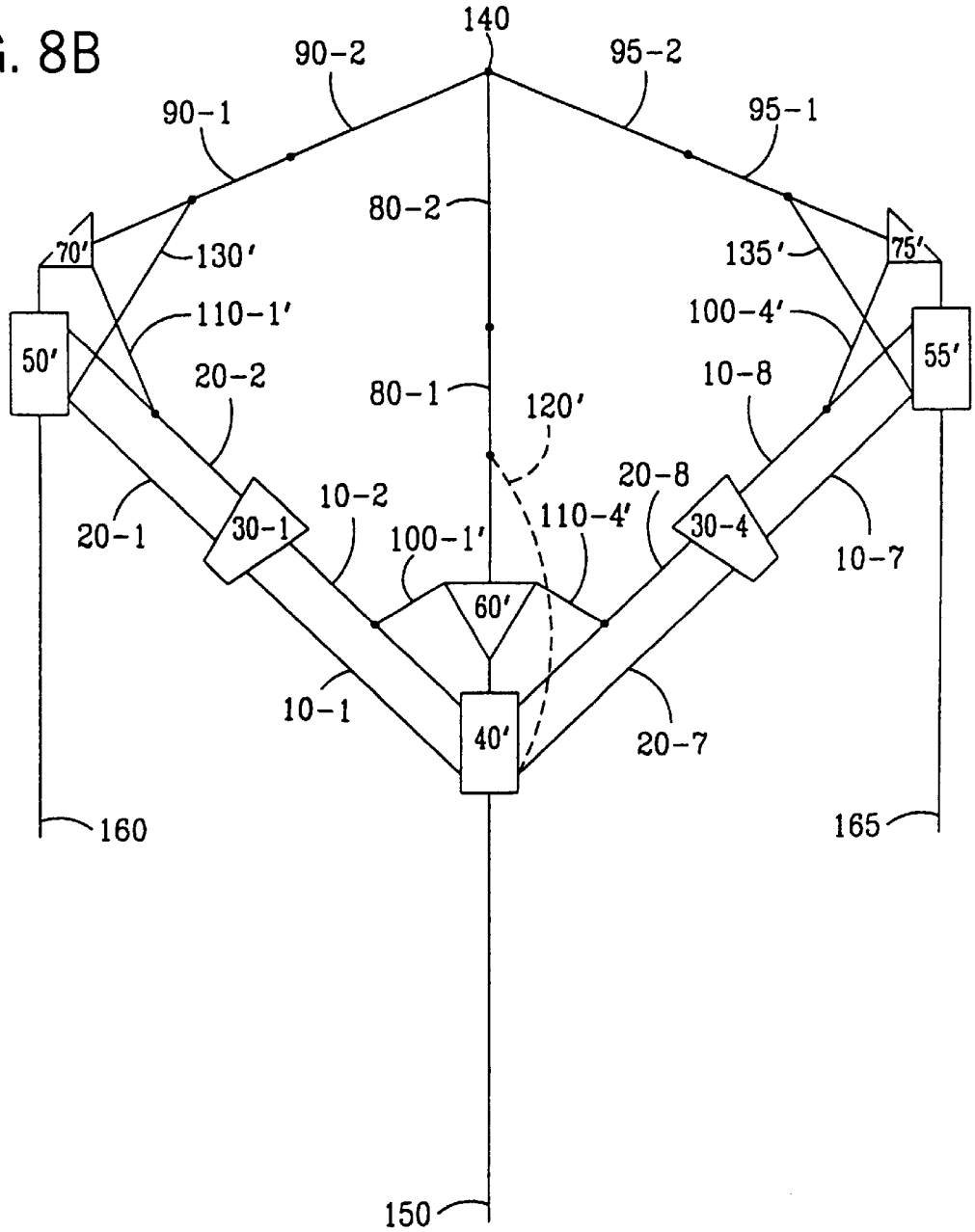
FIGS. 8A–8C show an exemplary shelter according to the present invention having a square shape defined by trusses according to the second exemplary embodiment illustrated in FIGS. 4–6.
Figure 8A:
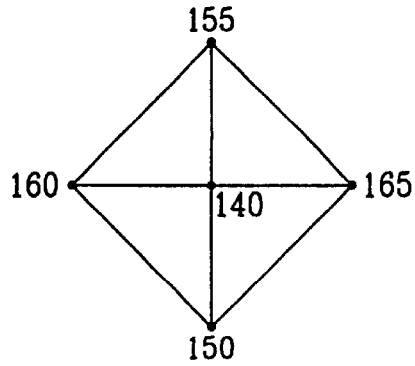
Figure 8C:
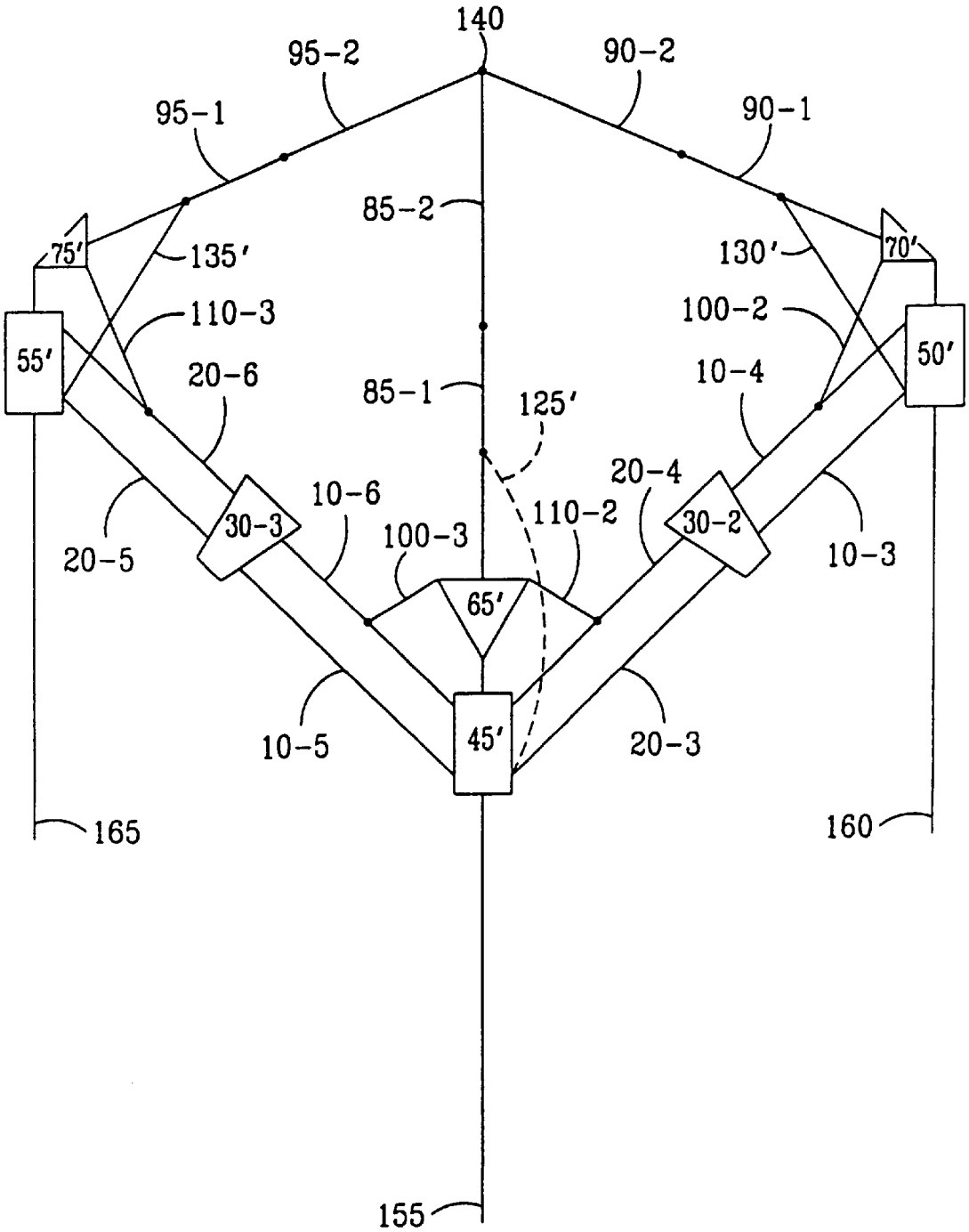
Figure 9:
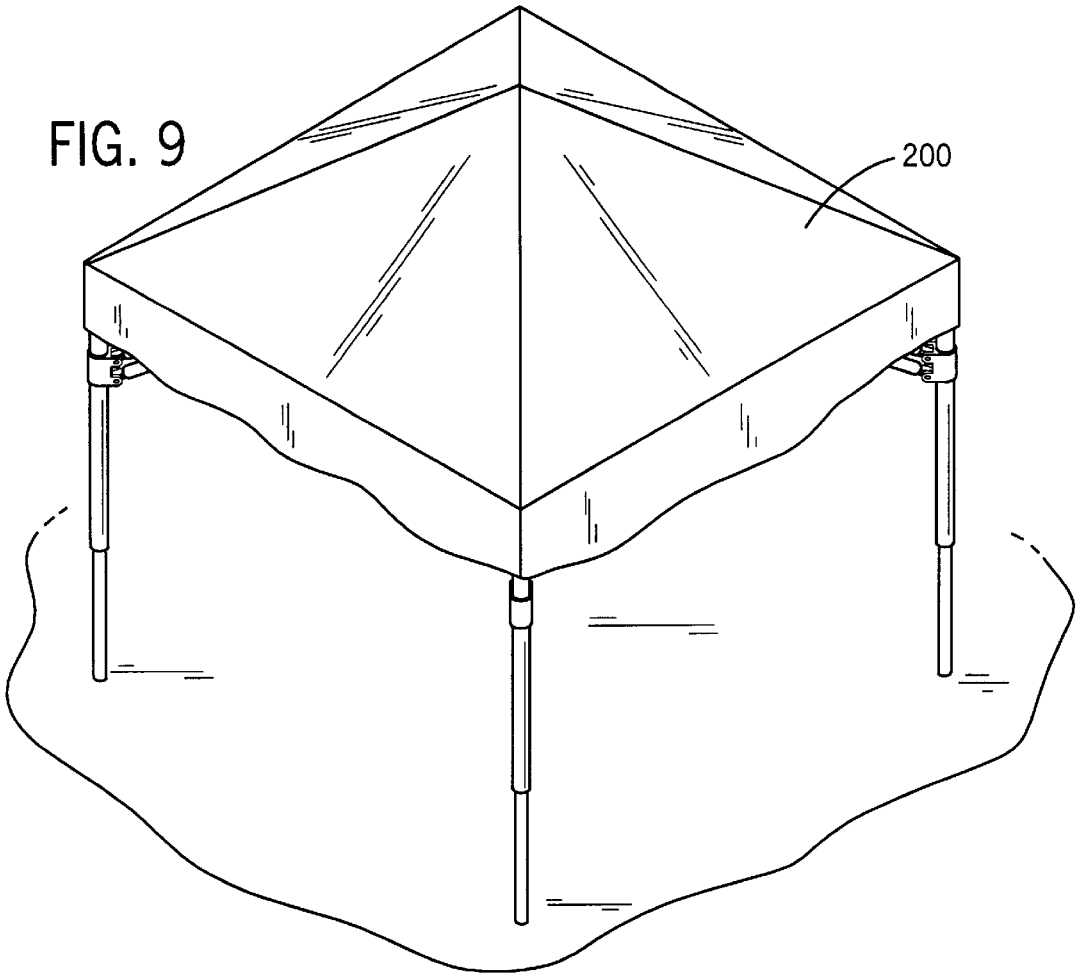
FIG. 9 is a view showing a covering supported on the legs and truss members.
Figure 10:
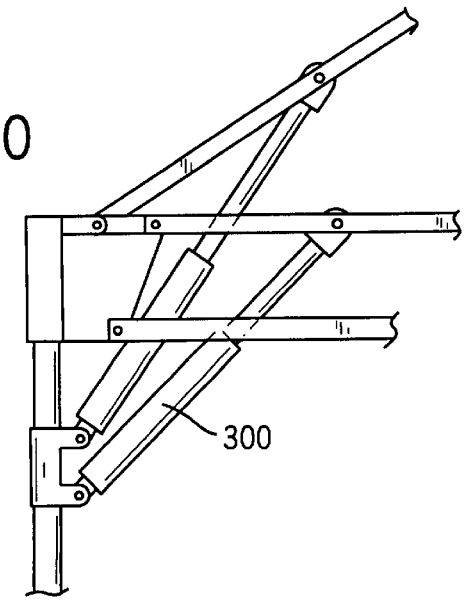
FIG. 10 shows an embodiment having gas extendable struts.

FIGS. 8A–8C show an exemplary shelter according to the present invention having four legs 150,155,160,165 connected by trusses defining the perimeter of a square shelter. It is envisioned that additional legs, sides and/or trusses may be combined so as to form any multi-sided polygon. The trusses shown in FIG. 8 are constructed according to the second exemplary embodiment described above. However, the trusses may alternatively be constructed according to the first exemplary embodiment described above, or any other arrangement within the scope of the appended claims.

A first pair of first eave bars 10-1,10-2 extend from a first center bracket 30-1 to a first end bracket 40'. Each of the first eave bars 10-1,10-2 is pivotally connected at its ends to the first center bracket 30-1 and to the first end bracket 40'.

A first pair of second eave bars 20-1,20-2 extend from the first center bracket 30-1 to a second end bracket 50'. Each of the second eave bars 20-1,20-2 is pivotally connected at its ends to the first center bracket 30-1 and to the second end bracket 50'.

A first support bar 100-1' extends from the eave bar 10-2 to a third end bracket 60'. The ends of the first support bar 100-1' are pivotally connected to an intermediate point along the eave bar 10-2 and to the third end bracket 60'. A second support bar 110-1' extends from the eave bar 20-2 to a fourth end bracket 70'. Ends of the second support bar 110-1' are pivotally connected to an intermediate point along the eave bar 20-2 and to the fourth end bracket 70'.

A second pair of first eave bars 10-3,10-4 extend from a second center bracket 30-2 to the second end bracket 50'. Each of the first eave bars 10-3,10-4 is pivotally connected at its ends to the second center bracket 30-2 and to the second end bracket 50'.

A second pair of second eave bars 20-3,20-4 extend from the second center bracket 30-2 to a fifth end bracket 45'. Each of the second eave bars 20-3,20-4 is pivotally connected at its ends to the second center bracket 30-2 and the fifth end bracket 45'.

A third support bar 100-2' extends from the eave bar 10-4 to the fourth end bracket 70'. The ends of the third support bar 100-2' are pivotally connected to an intermediate point along the eave bar 10-4 and to the fourth end bracket 70'. A fourth support bar 110-2' extends from the eave bar 20-4 to a sixth end bracket 65'. Ends of the fourth support bar 110-2' are pivotally connected to an intermediate point along the eave bar 20-4 and to the sixth end bracket 65'.

A third pair of first eave bars 10-5,10-6 extend from a third center bracket 30-3 to the fifth end bracket 45'. Each of the first eave bars 10-5,10-6 is pivotally connected at its ends to the third center bracket 30-3 and to the fifth end bracket 45'.

A third pair of second eave bars 20-5,20-6 extend from the third center bracket 30-3 to a seventh end bracket 55'. Each of the second eave bars 20-5,20-6 is pivotally connected at its ends to the third center bracket 30-3 and the seventh end bracket 55'.

A fifth support bar 100-3' extends from the eave bar 10-6 to the sixth end bracket 65'. The ends of the fifth support bar 100-3' are pivotally connected to an intermediate point along the eave bar 10-6 and to the sixth end bracket 65'. A sixth support bar 110-3' extends from the eave bar 20-6 to an eighth end bracket 75'. Ends of the sixth support bar 110-3' are pivotally connected to an intermediate point along the eave bar 20-6 and to the eighth end bracket 75'.

A fourth pair of first eave bars 10-7,10-8 extend from a fourth center bracket 30-4 to the seventh end bracket 55'. Each of the first eave bars 10-7,10-8 is pivotally connected at its ends to the fourth center bracket 30-4 and to the seventh end bracket 55'.

A fourth pair of second eave bars 20-7,20-8 extend from the fourth center bracket 30-4 to the first end bracket 40'. Each of the second eave bars 20-7,20-8 is pivotally connected at its ends to the fourth center bracket 30-4 and the first end bracket 40'.

A seventh support bar 100-4' extends from the eave bar 10-8 to the eighth end bracket 75'. The ends of the seventh support bar 100-4' are pivotally connected to an intermediate point along the eave bar 10-8 and to the eighth end bracket 75'. An eighth support bar 110-4' extends from the eave bar 20-8 to the first end bracket 60'. Ends of the eighth support bar 110-4' are pivotally connected to an intermediate point along the eave bar 20-8 and to the first end bracket 60'.

The first eave bars 10-1,10-2,10-3,10-4,10-5,10-6,10-7, 10-8 and the second eave bars 20-1,20-2,20-3,20-4,20-5,20-6,20-7,20-8 are all equal length.

The first and third end brackets 40',60' may be displaced with respect to one another along the first leg 150, the second and fourth end brackets 50',70' may be displaced with respect to one another along the second leg 160, the fifth and sixth end brackets 45',65' may be displaced with respect to one another along the third leg 155, and the seventh and eighth end brackets 55',75' may be displaced with respect to one another along the second leg 165. In the erected configuration of the truss, the first and third end brackets 40',60' are relatively proximal, the second and fourth end brackets 50',70' are relatively proximal, the fifth and sixth end brackets 45',65' are relatively proximal, and the seventh and eighth end brackets 55',75' are relatively proximal. In the collapsed configuration of the truss, the first and third end brackets 40,60 are relatively distal, the second and fourth end brackets 50,70 are relatively distal, the fifth and sixth end brackets 45,65 are relatively distal, and the seventh and eighth end brackets 55',75' are relatively distal.

A ridge structure for the truss includes a pair of first ridge bars 80-1,80-2, a pair of second ridge bars 90-1,90-2, a pair of third ridge bars 85-1,85-2, and a pair of fourth ridge bars 95-1,95-2. Ends of the ridge bars 80-1,90-1,85-1,95-1 are pivotally connected to the second, fourth, sixth and eighth end brackets 60',70',65',75', respectively, and pivotally connected to the corresponding ridge bars 80-2,90-2,85-1,95-1, respectively. Ends of the ridge bars 80-2,90-2,85-2,95-2, in addition to being pivotally connected to the corresponding ridge bars 80-1,90-1,85-1,95-1, respectively, are also pivotally connected to one another at the ridge peak 140. The range of motion of the pairs of ridge bars 80-1,80-2, 90-1, 90-2, 85-1,85-2 and 95-1,95-2 at their respective pivotal connections are constrained, such as by extensions of the ridge bars 80-1,90-1,85-1,95-1 to ensure a substantially collinear relationship in the erected configuration of the truss.

A ninth support bar 120' extends from the ridge bar 80-1 to the first end bracket 40'. The ends of the ninth support bar 120' are pivotally connected to an intermediate point along the ridge bar 80-1 and to the first end bracket 40'. A tenth support bar 130' extends from the ridge bar 90-1 to the third end bracket 50'. Ends of the tenth support bar 130' are pivotally connected to an intermediate point along the ridge bar 90-1 and to the third end bracket 50'. An eleventh support bar 125' extends from the ridge bar 85-1 to the fifth end bracket 45'. The ends of the eleventh support bar 125' are pivotally connected to an intermediate point along the ridge bar 85-1 and to the fifth end bracket 45'. A twelfth support bar 135' extends from the ridge bar 95-1 to the seventh end bracket 55'. The ends of the twelfth support bar 135' are pivotally connected to an intermediate point along the ridge bar 55-1 and to the seventh end bracket 55'.

A flexible covering 300 may be supported on the ridge beams and extend between the trusses, as is commonly known. The flexible covering may be made of canvas or another sheet material and provides at least a partial barrier between the ambient environment and the interior volume of the shelter.

Although a shelter having a square footprint has been shown in FIGS. 8A–8C, a shelter constructed according to the present invention may have a footprint in the shape of any polygon. For example, the shelter frame having a triangular footprint shown in FIG. 7 may be fitted with a comparable ridge structure and a flexible covering so as to form a three-sided shelter.

A rectangular shelter according to the present invention may be constructed with twin square shelters that share in common one truss and two legs. Specifically, each of the two major sides of the rectangle would include a right-side leg, a center leg and a left-side leg. Separate trusses would extend from the center leg to the respective side legs on each major side, and a common truss would extend between the center legs for both major sides. Of course, the pairs of right-side legs and left-side legs would be connected by respective trusses thus forming the two minor sides of the rectangle. The ridge peaks may be connected by either a rigid bar or a flexible link, e.g., aircraft wire, to form a ridge line for supporting the flexible covering between the ridge peaks. Such a rigid bar would be attached to the rectangular shelter after it is in its erected configuration, however, a flexible link could remain attached to the ridge peaks at and between the collapsed and erected configurations. Shelters having different or more complex footprints could also be constructed by using multiple occurrences of trusses and/or legs shared in common and connected ridge peaks.

A number of variations are also envisioned for trusses, frames and shelters according to the present invention. In particular, it is envisioned that one or more gas charged extendable struts might be installed as the support bars for the ridge bars. Such a substitution would aid in erecting the shelter symmetrically.

Additionally, it is envisioned that the ridge beams may have an alternative arrangement such as a multi-segment tubular element having an elastic tensile element, e.g., a so-called "bungee cord", extending through and retaining the segments in an assembled arrangement.

Additional advantages and modifications will readily occur to those skilled in the art. Therefore, the invention in its broader aspects is not limited to the specific details, and representative devices, shown and described herein. Accordingly, various modifications may be made without departing from the spirit and scope of the general inventive concept as defined by the appended claims and their equivalents.

I claim:

1. A truss adapted for assuming a collapsed configuration and an erected configuration, the truss comprising:

a pair of first eave bars extending from a center bracket to a first end bracket, each of said pair of first bars being pivotally connected to said center bracket and to said first end bracket, said pair of first eave bars pivoting with respect to said first and center brackets and being parallel to one another between the collapsed configuration and the erected configuration;

a pair of second eave bars extending from said center bracket to a second end bracket, each of said pair of second bars being pivotally connected to said center bracket and to said second end bracket, said pair of second eave bars pivoting with respect to said second and center brackets and being parallel to one another between the collapsed configuration and the erected configuration, wherein the pivotal connections between said center bracket and each bar of said pairs of first and second eave bars define a quadrilateral having relatively parallel first and second opposite sides, said first side is defined by the pivotal connections between first ones of said pairs of first and second eave bars, and said second side is defined by the pivotal connections between second ones of said pairs of first and second eave bars, and wherein said first side is relatively shorter than said second side.

2. The truss according to claim 1, wherein each bar of said pairs of first and second eave bars have the same length.

3. The truss according to claim 1, wherein said pairs of first eave bars, said center bracket and said first end bracket define a first parallelogram linkage, and wherein said pairs of second eave bars, said center bracket and said second end bracket define a second parallelogram linkage.

4. The truss according to claim 1, further comprising:

a first support bar extending between said first one of said pair of first eave bars and a third end bracket, said first support bar being pivotally connected to said first one of said pair of first eave bars and to said third end bracket; and a second support bar extending between said first one of said pair of second eave bars and a fourth end bracket, said second support bar being pivotally connected to said first one of said pair of second eave bars and to said fourth end bracket;

wherein said first and third end brackets are relatively slidable along a first axis, and said second and fourth end brackets are relatively slidable along a second axis, said first and second axes being parallel.

5. The truss according to claim 4, further comprising:

a pair of first ridge bars, a first one of said pair of first ridge bars being pivotally connected to said first end bracket;

a pair of second ridge bars, a first one of said pair of second ridge bars being pivotally connected to said second end bracket; and second ones of said pairs of first and second ridge bars being pivotally connected to corresponding ones of said first ones of said pairs of first and second ridge bars and being pivotally connected to one another.

6. The truss according to claim 5, further comprising:

a third support bar extending between said first one of said pair of first ridge bars and said third end bracket, said third support bar being pivotally connected to said first one of said pair of first ridge bars and to said third end bracket; and a fourth support bar extending between said first one of said pair of second ridge bars and said fourth end bracket, said fourth support bar being pivotally connected to said first one of said pair of second ridge bars and to said fourth end bracket.

7. The truss according to claim 6, wherein at least one of said third and fourth support bars is a gas charged extendable strut.

8. The truss according to claim 6, wherein said third and fourth support bars are gas charged extendable struts.

9. The truss according to claim 1, further comprising:

a first support bar extending between said second one of said pair of first eave bars and a third end bracket, said first support bar being pivotally connected to said second one of said pair of first eave bars and to said third end bracket; and a second support bar extending between said second one of said pair of second eave bars and a fourth end bracket, said second support bar being pivotally connected to said second one of said pair of second eave bars and to said fourth end bracket;

wherein said first and third end brackets are relatively slidable along a first axis, and said second and fourth end brackets are relatively slidable along a second axis, said first and second axes being parallel.

10. The truss according to claim 9, further comprising:

a pair of first ridge bars, a first one of said pair of first ridge bars being pivotally connected to said third end bracket;

a pair of second ridge bars, a first one of said pair of second ridge bars being pivotally connected to said fourth end bracket; and second ones of said pairs of first and second ridge bars being pivotally connected to corresponding ones of said first ones of said pairs of first and second ridge bars and being pivotally connected to one another.

11. The truss according to claim 10, further comprising:

a third support bar extending between said first one of said pair of first ridge bars and said first end bracket, said third support bar being pivotally connected to said first one of said pair of first ridge bars and to said first end bracket; and a fourth support bar extending between said first one of said pair of second ridge bars and said second end bracket, said fourth support bar being pivotally connected to said first one of said pair of second ridge bars and to said second end bracket.

12. The truss according to claim 11, wherein at least one of said third and fourth support bars is a gas charged extendable strut.

13. The truss according to claim 11, wherein said third and fourth support bars are gas charged extendable struts.

14. A shelter frame adapted for assuming a collapsed configuration and an erect configuration, the shelter frame comprising:

at least three legs, each of said legs having an upper portion and a lower portion;

at least two truss members connected to each of said legs, each of said truss members including:

a first end bracket supported on a first one of said legs and a second end bracket supported on a second one of said legs;

a pair of first eave bars extending from a center bracket to said first end bracket, each of said pair of first bars being pivotally connected to said center bracket and to said first end bracket, said pair of first eave bars pivoting with respect to said first and center brackets and being parallel to one another between the collapsed configuration and the erected configuration; and a pair of second eave bars extending from said center bracket to said second end bracket, each of said pair of second bars being pivotally connected to said center bracket and to said second end bracket, said pair of second eave bars pivoting with respect to said second and center brackets and being parallel to one another between the collapsed configuration and the erected configuration.

15. The shelter frame according to claim 14, wherein each bar of said pairs of first and second eave bars have the same length.

16. The shelter frame according to claim 15, wherein said pair of first eave bars, said center bracket and said first end bracket define a first parallelogram linkage, and wherein said pair of second eave bars, said center bracket and said second end bracket define a second parallelogram linkage.

17. The shelter frame according to claim 14, wherein the pivotal connections between said center bracket and each bar of said pairs of first and second eave bars define a quadrilateral having relatively parallel first and second opposite sides, said first side is defined by the pivotal connections between first ones of said pairs of first and second eave bars, and said second side is defined by the pivotal connections between second ones of said pairs of first and second eave bars, and wherein said first side is relatively shorter than said second side.

18. The shelter frame according to claim 17, further comprising:

a first support bar extending between said first one of said pair of first eave bars and a third end bracket, said first support bar being pivotally connected to said first one of said pair of first eave bars and to said third end bracket; and a second support bar extending between said first one of said pair of second eave bars and a fourth end bracket, said second support bar being pivotally connected to said first one of said pair of second eave bars and to said fourth end bracket;

wherein said first end bracket is fixed at an upper end of said first leg and said third end bracket slides relative to said first bracket along said first leg, and said second end bracket is fixed at an upper end of said second leg and said fourth end bracket slides relative to said second end bracket along said second leg.

19. The shelter frame according to claim 18, further comprising:

a pair of first ridge bars, a first one of said pair of first ridge bars being pivotally connected to said first end bracket;

a pair of second ridge bars, a first one of said pair of second ridge bars being pivotally connected to said second end bracket; and second ones of said pairs of first and second ridge bars being pivotally connected to corresponding ones of said first ones of said pairs of first and second ridge bars and being pivotally connected to one another.

20. The shelter frame according to claim 19, further comprising:

a third support bar extending between said first one of said pair of first ridge bars and said third end bracket, said third support bar being pivotally connected to said first one of said pair of first ridge bars and to said third end bracket; and a fourth support bar extending between said first one of said pair of second ridge bars and said fourth end bracket, said fourth support bar being pivotally connected to said first one of said pair of second ridge bars and to said fourth end bracket.

21. The shelter frame according to claim 20, wherein at least one of said third and fourth support bars is a gas charged strut.

22. The shelter frame according to claim 20, wherein said third and fourth support bars are gas charged struts.

23. The shelter frame according to claim 20, wherein said third support bar has a length that is relatively greater than said first support bar and said first one of said pair of first ridge bars, and said fourth support bar has a length that is relatively greater than said second support bar and said first one of said pair of second ridge bars.

24. The shelter frame according to claim 17, further comprising:

a first support bar extending between said second one of said pair of first eave bars and a third end bracket, said first support bar being pivotally connected to said second one of said pair of first eave bars and to said third end bracket; and a second support bar extending between said second one of said pair of second eave bars and a fourth end bracket, said second support bar being pivotally connected to said second one of said pair of second eave bars and to said fourth end bracket;

wherein said third end bracket is fixed at an upper end of said first leg and said first end bracket slides relative to said third end bracket along said first leg, and said fourth end bracket is fixed at an upper end of said second leg and said second end bracket slides relative to said fourth end bracket along said second leg.

25. The shelter frame according to claim 24, further comprising:

a pair of first ridge bars, a first one of said pair of first ridge bars being pivotally connected to said third end bracket;

a pair of second ridge bars, a first one of said pair of second ridge bars being pivotally connected to said fourth end bracket; and second ones of said pairs of first and second ridge bars being pivotally connected to corresponding ones of said first ones of said pairs of first and second ridge bars and being pivotally connected to one another.

26. The shelter frame according to claim 25, further comprising:

a third support bar extending between said first one of said pair of first ridge bars and said first end bracket, said third support bar being pivotally connected to said first one of said pair of first ridge bars and to said first end bracket; and a fourth support bar extending between said first one of said pair of second ridge bars and said second end bracket, said fourth support bar being pivotally connected to said first one of said pair of second ridge bars and to said second end bracket.

27. The shelter frame according to claim 26, wherein at least one of said third and fourth support bars is a gas charged strut.

28. The shelter frame according to claim 26, wherein said third and fourth support bars are gas charged struts.

29. The shelter frame according to claim 26, wherein said third support bar has a length that is relatively greater than said first support bar and relatively less than said first one of said pair of first ridge bars, and said fourth support bar has a length that is relatively greater than said second support bar and relatively less than said first one of said pair of second ridge bars.

30. A square shelter adapted for assuming a collapsed configuration and an erect configuration, the shelter comprising:

four legs, each of said legs defining a vertex of the square;

four truss members defining a perimeter of the square, each of said truss members connecting two of said legs, said truss members including:

a first truss member having a first end bracket supported on a first one of said legs and a second end bracket supported on a second one of said legs; a first pair of first eave bars extending from a first center bracket to said first end bracket, each of said first pair of first bars being pivotally connected to said first center bracket and to said first end bracket, said first pair of first eave bars pivoting with respect to said first end and first center brackets and being parallel to one another between the collapsed configuration and the erected configuration; and a first pair of second eave bars extending from said first center bracket to said second end bracket, each of said first pair of second bars being pivotally connected to said first center bracket and to said second end bracket, said first pair of second eave bars pivoting with respect to said second end and first center brackets and being parallel to one another between the collapsed configuration and the erected configuration;

a second truss member having a third end bracket supported on a third one of said legs; a second pair of first eave bars extending from a second center bracket to said second end bracket, each of said second pair of first bars being pivotally connected to said second center bracket and to said second end bracket, said second pair of first eave bars pivoting with respect to said second end and second center brackets and being parallel to one another between the collapsed configuration and the erected configuration; and a second pair of second eave bars extending from said second center bracket to said third end bracket, each of said second pair of second bars being pivotally connected to said second center bracket and to said third end bracket, said second pair of second eave bars pivoting with respect to said third end and second center brackets and being parallel to one another between the collapsed configuration and the erected configuration;

a third truss member having a fourth end bracket supported on a fourth one of said legs; a third pair of first eave bars extending from a third center bracket to said third end bracket, each of said third pair of first bars being pivotally connected to said third center bracket and to said third end bracket, said third pair of first eave bars pivoting with respect to said third end and third center brackets and being parallel to one another between the collapsed configuration and the erected configuration; and a third pair of second eave bars extending from said third center bracket to said fourth end bracket, each of said third pair of second bars being pivotally connected to said third center bracket and to said fourth end bracket, said third pair of second eave bars pivoting with respect to said fourth end and third center brackets and being parallel to one another between the collapsed configuration and the erected configuration; and a fourth truss member extending between said fourth and first end brackets; a fourth pair of first eave bars extending from a fourth center bracket to said fourth end bracket, each of said fourth pair of first bars being pivotally connected to said fourth center bracket and to said fourth end bracket, said fourth pair of first eave bars pivoting with respect to said fourth end and fourth center brackets and being parallel to one another between the collapsed configuration and the erected configuration; and a fourth pair of second eave bars extending from said fourth center bracket to said first end bracket, each of said fourth pair of second bars being pivotally connected to said fourth center bracket and to said first end bracket, said fourth pair of second eave bars pivoting with respect to said first end and fourth center brackets and being parallel to one another between the collapsed configuration and the erected configuration; and a covering supported on said legs and said truss members, said covering being adapted for extending between said truss members in the erected configuration.

31. The square shelter according to claim 30, wherein the pivotal connections between each of said center brackets and each respective bar of said pairs of first and second eave bars define a quadrilateral having relatively parallel first and second opposite sides, said first side is defined by the pivotal connections between first ones of said pairs of first and second eave bars, and said second side is defined by the pivotal connections between second ones of said pairs of first and second eave bars, and wherein said first side is relatively shorter than said second side.

32. The square shelter according to claim 31, further comprising:

a first support bar extending between said first one of said first pair of first eave bars and a fifth end bracket, said first support bar being pivotally connected to said first one of said first pair of first eave bars and to said fifth end bracket;

a second support bar extending between said first one of said first pair of second eave bars and a sixth end bracket, said second support bar being pivotally connected to said first one of said first pair of second eave bars and to said sixth end bracket;

a third support bar extending between said first one of said second pair of first eave bars and said sixth end bracket, said third support bar being pivotally connected to said first one of second said pair of first eave bars and to said sixth end bracket;

a fourth support bar extending between said first one of said second pair of second eave bars and a seventh end bracket, said fourth support bar being pivotally connected to said first one of said second pair of second eave bars and to said seventh end bracket;

a fifth support bar extending between said first one of said third pair of first eave bars and said seventh end bracket, said fifth support bar being pivotally connected to said first one of said third pair of first eave bars and to said seventh end bracket;

a sixth support bar extending between said first one of said third pair of second eave bars and a eighth end bracket, said sixth support bar being pivotally connected to said first one of said third pair of second eave bars and to said eighth end bracket;

a seventh support bar extending between said first one of said fourth pair of first eave bars and said eighth end bracket, said seventh support bar being pivotally connected to said fourth one of second said pair of first eave bars and to said eighth end bracket; and an eighth support bar extending between said first one of said fourth pair of second eave bars and said first end bracket, said eighth support bar being pivotally connected to said first one of said fourth pair of second eave bars and to said first end bracket;

wherein said first end bracket is fixed at an upper end of said first leg and said fifth end bracket slides relative to said first bracket along said first leg, said second end bracket is fixed at an upper end of said second leg and said sixth end bracket slides relative to said second bracket along said second leg, said third end bracket is fixed at an upper end of said third leg and said seventh end bracket slides relative to said third end bracket along said third leg, and said fourth end bracket is fixed at an upper end of said fourth leg and said eighth end bracket slides relative to said fourth end bracket along said fourth leg.

33. The square shelter according to claim 32, further comprising:

a pair of first ridge bars, a first one of said pair of first ridge bars being pivotally connected to said first end bracket;

a pair of second ridge bars, a first one of said pair of second ridge bars being pivotally connected to said second end bracket;

a pair of third ridge bars, a first one of said pair of third ridge bars being pivotally connected to said third end bracket; and a pair of fourth ridge bars, a first one of said pair of fourth ridge bars being pivotally connected to said fourth end bracket;

wherein second ones of said pairs of first, second, third and fourth ridge bars are pivotally connected to corresponding ones of said first ones of said pairs of first, second, third and fourth ridge bars and are pivotally connected to one another.

34. The square shelter according to claim 33, further comprising:

a ninth support bar extending between said first one of said pair of first ridge bars and said fifth end bracket, said ninth support bar being pivotally connected to said first one of said pair of first ridge bars and to said fifth end bracket;

a tenth support bar extending between said first one of said pair of second ridge bars and said sixth end bracket, said tenth support bar being pivotally connected to said first one of said pair of second ridge bars and to said sixth end bracket;

an eleventh support bar extending between said first one of said pair of third ridge bars and said seventh end bracket, said eleventh support bar being pivotally connected to said first one of said pair of third ridge bars and to said seventh end bracket; and a twelfth support bar extending between said first one of said pair of fourth ridge bars and said eighth end bracket, said twelfth support bar being pivotally connected to said first one of said pair of fourth ridge bars and to said eighth end bracket.

35. The square shelter according to claim 31, further comprising:

a first support bar extending between said second one of said first pair of first eave bars and a fifth end bracket, said first support bar being pivotally connected to said second one of said first pair of first eave bars and to said fifth end bracket;

a second support bar extending between said second one of said first pair of second eave bars and a sixth end bracket, said second support bar being pivotally connected to said second one of said first pair of second eave bars and to said sixth end bracket;

a third support bar extending between said second one of said second pair of first eave bars and said sixth end bracket, said third support bar being pivotally connected to said second one of second said pair of first eave bars and to said sixth end bracket;

a fourth support bar extending between said second one of said second pair of second eave bars and a seventh end bracket, said fourth support bar being pivotally connected to said second one of said second pair of second eave bars and to said seventh end bracket;

a fifth support bar extending between said second one of said third pair of first eave bars and said seventh end bracket, said fifth support bar being pivotally connected to said second one of said third pair of first eave bars and to said seventh end bracket;

a sixth support bar extending between said second one of said third pair of second eave bars and an eighth end bracket, said sixth support bar being pivotally connected to said second one of said third pair of second eave bars and to said eighth end bracket;

a seventh support bar extending between said second one of said fourth pair of first eave bars and said eighth end bracket, said seventh support bar being pivotally connected to said second one of said fourth pair of first eave bars and to said eighth end bracket; and an eighth support bar extending between said second one of said fourth pair of second eave bars and said first end bracket, said eighth support bar being pivotally connected to said second one of said fourth pair of second eave bars and to said first end bracket;

wherein said fifth end bracket is fixed at an upper end of said first leg and said first end bracket slides relative to said fifth bracket along said first leg, said sixth end bracket is fixed at an upper end of said second leg and said second end bracket slides relative to said sixth bracket along said second leg, said seventh end bracket is fixed at an upper end of said third leg and said third end bracket slides relative to said seventh end bracket along said third leg, and said eighth end bracket is fixed at an upper end of said fourth leg and said fourth end bracket slides relative to said eighth end bracket along said fourth leg.

36. The square shelter according to claim 35, further comprising:

a pair of first ridge bars, a first one of said pair of first ridge bars being pivotally connected to said fifth end bracket;

a pair of second ridge bars, a first one of said pair of second ridge bars being pivotally connected to said sixth end bracket;

a pair of third ridge bars, a first one of said pair of third ridge bars being pivotally connected to said seventh end bracket; and a pair of fourth ridge bars, a first one of said pair of fourth ridge bars being pivotally connected to said eighth end bracket;

wherein second ones of said pairs of first, second, third and fourth ridge bars are pivotally connected to corresponding ones of said first ones of said pairs of first, second, third and fourth ridge bars and are pivotally connected to one another.

37. The shelter frame according to claim 36, further comprising:

a ninth support bar extending between said first one of said pair of first ridge bars and said first end bracket, said ninth support bar being pivotally connected to said first one of said pair of first ridge bars and to said first end bracket;

a tenth support bar extending between said first one of said pair of second ridge bars and said second end bracket, said tenth support bar being pivotally connected to said first one of said pair of second ridge bars and to said second end bracket;

an eleventh support bar extending between said first one of said pair of third ridge bars and said third end bracket, said eleventh support bar being pivotally connected to said first one of said pair of third ridge bars and to said third end bracket; and a twelfth support bar extending between said first one of said pair of fourth ridge bars and said fourth end bracket, said twelfth support bar being pivotally connected to said first one of said pair of fourth ridge bars and to said fourth end bracket.

* * * * *